US010016905B2

(12) United States Patent
Kobayashi

(10) Patent No.: US 10,016,905 B2
(45) Date of Patent: Jul. 10, 2018

(54) CUTTING APPARATUS, CUTTING METHOD, AND NON-TRANSITORY COMPUTER-READABLE RECORDING MEDIUM

(71) Applicant: MIMAKI ENGINEERING CO., LTD., Tomi (JP)

(72) Inventor: Hisayuki Kobayashi, Tomi (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 15 days.

(21) Appl. No.: 14/024,640

(22) Filed: Sep. 12, 2013

(65) Prior Publication Data

US 2014/0013908 A1 Jan. 16, 2014

Related U.S. Application Data

(63) Continuation of application No. PCT/JP2011/080187, filed on Dec. 27, 2011.

(30) Foreign Application Priority Data

Mar. 16, 2011 (JP) ..... 2011-058503

(51) Int. Cl.
*B26D 3/08* (2006.01)
*B26D 5/00* (2006.01)
(Continued)

(52) U.S. Cl.
CPC ..... *B26D 5/005* (2013.01); *B26D 3/08* (2013.01); *B26D 3/14* (2013.01); *B26F 1/3813* (2013.01);
(Continued)

(58) Field of Classification Search
CPC ..... B26D 5/005; B26D 3/08; Y10T 83/9372; Y10T 83/6572; Y10T 83/929; Y10T 83/6529; B26F 1/02
(Continued)

(56) References Cited

U.S. PATENT DOCUMENTS 4,848,309 A * 7/1989 Alderete ..... B25D 3/00 125/40
4,920,495 A * 4/1990 Pilkington ..... B26D 3/085 700/167
(Continued)

FOREIGN PATENT DOCUMENTS

JP 61-109692 5/1986
JP 02-243292 9/1990
(Continued)

OTHER PUBLICATIONS

International Search Report for corresponding International Application No. PCT/JP2011/080187, dated Feb. 28, 2012.
(Continued)

*Primary Examiner* — Kenneth E. Peterson
*Assistant Examiner* — Nhat Chieu Do
(74) *Attorney, Agent, or Firm* — JCIPRNET

(57) ABSTRACT

A cutting apparatus includes a blade relatively movable with respect to a media to cut the media along a cutting line. The blade is so constructed to pre-cut the media along the cutting line to leave non-cutting portions and to cut the non-cutting portions after pre-cutting the media.

9 Claims, 13 Drawing Sheets

(51) Int. Cl.
*B26D 3/14* (2006.01)
*B26F 1/38* (2006.01)

(52) U.S. Cl.
CPC ..... *B26D 5/00* (2013.01); *Y10T 83/0529* (2015.04); *Y10T 83/6572* (2015.04); *Y10T 83/929* (2015.04); *Y10T 83/9372* (2015.04)

(58) Field of Classification Search
USPC ..... 83/880, 428, 30, 427, 575, 25, 103, 695, 83/678, 881, 485, 614, 564, 862–865
See application file for complete search history.

(56) References Cited

U.S. PATENT DOCUMENTS

| | | | | |
|---|---|---|---|---|
| 5,148,732 | A * | 9/1992 | Striebig | B23D 45/10 144/3.1 |
| 5,275,077 | A * | 1/1994 | Kobayashi | 83/880 |
| 5,443,194 | A * | 8/1995 | Takahashi | B26D 3/12 225/106 |
| 5,979,525 | A * | 11/1999 | Durney | B23D 47/12 144/136.95 |
| 6,112,630 | A * | 9/2000 | Miura | B26D 5/00 700/114 |
| 2006/0016316 | A1* | 1/2006 | Madon et al. | 83/879 |
| 2009/0293695 | A1* | 12/2009 | Sacchetta | B26D 1/045 83/614 |
| 2011/0179929 | A1* | 7/2011 | Angel | B26D 1/04 83/614 |

FOREIGN PATENT DOCUMENTS

| | | |
|---|---|---|
| JP | 02-262995 | 10/1990 |
| JP | 06-155383 | 6/1994 |
| JP | 06-206192 | 7/1994 |
| JP | 07-164058 | 6/1995 |
| JP | 07-042683 | 8/1995 |
| JP | 07-237183 | 9/1995 |
| JP | 2001-088088 | 4/2001 |
| JP | 2005-111814 | 4/2005 |
| JP | 2006-239819 | 9/2006 |
| JP | 2009-160670 | 7/2009 |

OTHER PUBLICATIONS

Chinese of Action for corresponding CN Application No. 201180069306.7, dated Nov. 6, 2015.
Extended European Search Report for corrresponding EP Application No. 11860977.5-1702, dated Jun. 2, 2015.
Chinese Office Action for corresponding CN Application No. 201180069306.7, dated Oct. 10, 2014.
Chinese Office Action for corresponding CN Application No. 201180069306.7, dated May 19, 2015.
Japanese Office Action for corresponding JP Application No. 2011-058503, dated Nov. 26, 2014.
Korean Office Action for corresponding KR Application No. 10-2013-7024201, dated Nov. 26, 2014.

* cited by examiner

CUTTING APPARATUS, CUTTING METHOD, AND NON-TRANSITORY COMPUTER-READABLE RECORDING MEDIUM

CROSS-REFERENCE TO RELATED APPLICATIONS

The present application is a continuation application of International Application No. PCT/JP2011/080187, filed Dec. 27, 2011, which claims priority to Japanese Patent Application No. 2011-058503, filed Mar. 16, 2011. The contents of these applications are incorporated herein by reference in their entirety.

BACKGROUND OF THE INVENTION

Field of the Invention

The present invention relates to a cutting apparatus, a cutting method, and a non-transitory computer-readable recording medium.

Discussion of the Background

JP-A-2005-111814 discloses a technique for performing a dotted line cut with respect to the media. See JP-A-2005-111814, for example, paragraph [0055] and FIG. 14.

SUMMARY OF THE INVENTION

According to one aspect of the present invention, a cutting apparatus includes a blade relatively movable with respect to a media to cut the media along a cutting line. The blade is so constructed to pre-cut the media along the cutting line to leave non-cutting portions and to cut the non-cutting portions after pre-cutting the media.

According to another aspect of the present invention, a cutting apparatus includes a support base to support a media, a moving device to move the media on the support base in a second direction, and a blade movable in a vertical direction and a first direction crossing the second direction. The blade is so constructed to cut the media along a cutting line moving in the first direction and forward and backward directions in the second direction relatively with respect to the media. The blade is so constructed to pre-cut the media along the cutting line to leave non-cutting portions and to cut the non-cutting portions after pre-cutting the media.

According to further aspect of the present invention, a cutting method includes moving a blade relatively with respect to a media to pre-cut the media along a cutting line to leave non-cutting portions, and moving the blade relatively with respect to the media to cut the non-cutting portions after pre-cutting the media.

According to the other aspect of the present invention, a non-transitory computer-readable recording medium having program code stored thereon which, when executed by a computer, causes the computer to perform a cutting method for performing a plurality of application programs. The cutting method includes moving a blade relatively with respect to a media to pre-cut the media along a cutting line to leave non-cutting portions, and moving the blade relatively with respect to the media to cut the non-cutting portions after pre-cutting the media.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
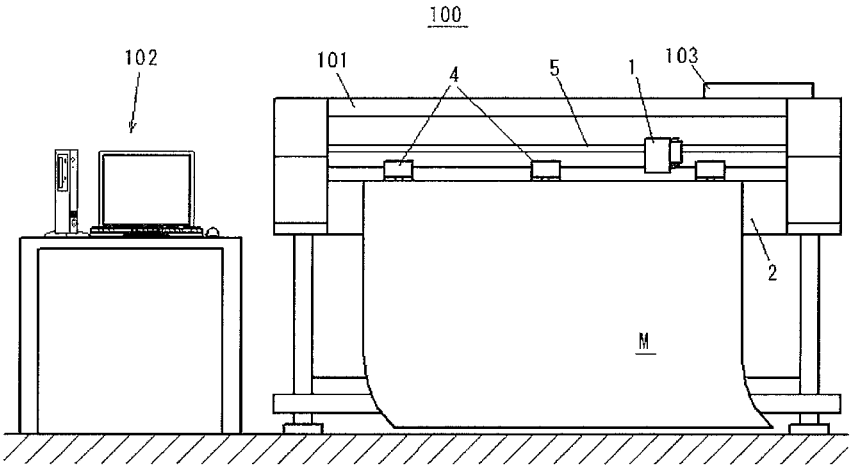
FIG. 1 is an explanatory view illustrating a cutting apparatus according to a first embodiment of the present invention.

The embodiments will now be described with reference to the accompanying drawings, wherein like reference numerals designate corresponding or identical elements throughout the various drawings.

First Embodiment

Figure 2:
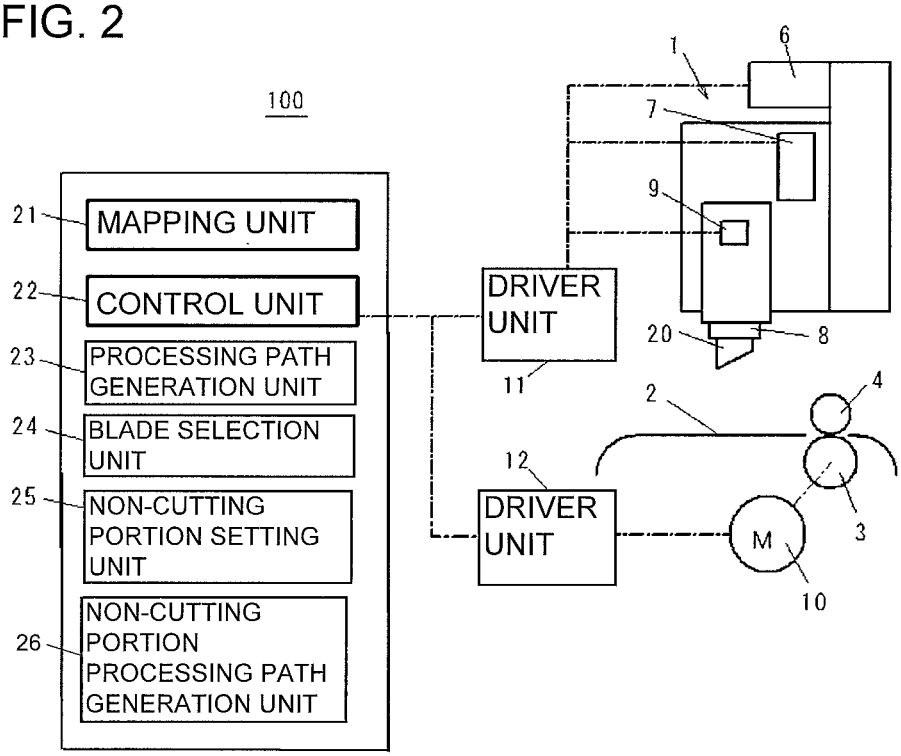
FIG. 2 is a configuration view illustrating the cutting apparatus of FIG. 1.
Figure 3:
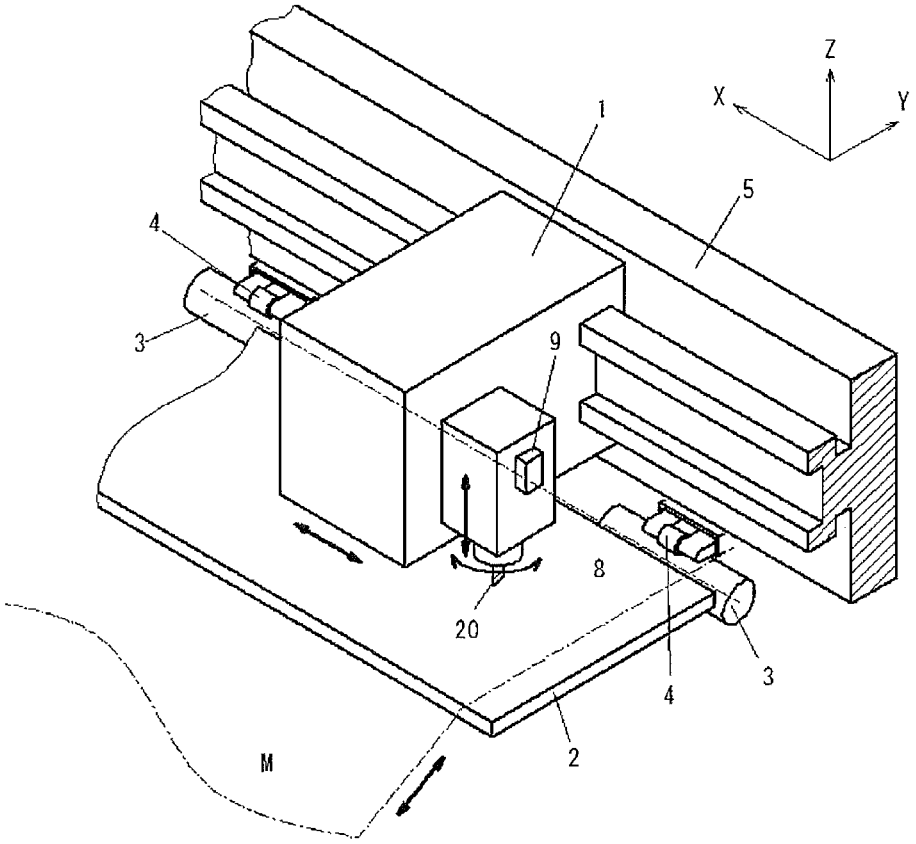
FIG. 3 is a perspective view illustrating the vicinity of a cutter unit.

FIG. 1 is an explanatory view illustrating a cutting apparatus according to a first embodiment of the present invention. FIG. 2 is a configuration view illustrating the cutting apparatus of FIG. 1. FIG. 3 is a perspective view illustrating the vicinity of a cutter unit. A cutting apparatus 100 is configured of a cutting plotter 101, and a computer 102 that is connected to the cutting plotter 101. The cutting plotter 101 includes a cutter unit 1 which has a holder 8 where various types of blades 20 are installed, a plurality of grid rollers 3 that are disposed inside a platen 2 which is a support base for a media M, upper portions thereof being exposed from an upper surface of the platen 2, and move the media M, and a plurality of pinch rollers 4 that correspond to the respective grid rollers 3. The plurality of grid rollers 3 are placed at predetermined intervals from each other in an X-axis direction, and are driven by one motor 10. The pinch roller 4 is one of structures that are placed above the platen 2, is urged at a predetermined pressure with respect to the grid roller 3, and is driven and rotated by the grid roller 3.

A movement of the cutter unit 1 is controlled in the X-axis direction and a Z-axis direction by an X-axis driving mechanism and a Z-axis driving mechanism. The X-axis driving mechanism has a guide rail 5 that installs the cutter unit 1 in a linearly movable manner, a timing belt (not illustrated) that is disposed in parallel with the guide rail 5, and a motor 6 that drives the timing belt. The Z-axis driving mechanism has a linear movement guide, which is not illustrated herein, and a motor 7 that are disposed inside the cutter unit 1.

The holder 8 is configured in such a manner as to be rotatable about a Z axis and rotates following a movement of the cutter unit 1 in X and Y directions. In the holder 8 that has such a configuration, it is necessary to perform a so-called discarding operation so as to direct the blade 20 in a cut direction. The discarding operation is to cut a linear-shaped cut line of approximately 5 mm at an unused point such as a corner of the media M and to direct the blade 20 in a direction of the cut line. In the embodiment, the direction of the blade 20 is performed by the discarding operation.

Also, the holder 8 can fix a rotation of the blade 20 at a predetermined angle by using an actuator 9 of a solenoid or the like. In other words, the rotation of the holder 8 is temporarily fixed by the actuator 9 so as to direct the blade 20 in a predetermined direction by the discarding operation and maintain the posture. For example, the rotation of the holder 8 is fixed by pressing a movable portion of the solenoid with respect to the holder 8.

In the cutting plotter 101, a controller 103 that controls the cutting plotter 101 is disposed. The controller 103 and the computer 102 are integrated with each other to process information of the cutting apparatus 100, and constitute a mapping unit 21 that maps a cut object S in the media M by storing a predetermined program in hardware of the controller 103 and the computer 102, a control unit 22 that performs processing on the media M following a processing path 30, a processing path generation unit 23 that generates the processing path 30 of the cut object S, a blade selection unit 24 that selects a blade used in the cutting from a plurality of blades which are registered, a non-cutting portion setting unit 25 that sets a non-cutting portion 32 on a line segment 31, and a non-cutting portion processing path generation unit 26 that generates the processing path by using the blade 20 which is selected by the non-cutting portion 32. Also, the control unit 22 is connected to the cutter unit 1, each of the motors 6, 7, and 10 of the grid rollers 3, and driver units 11 and 12 of the actuator 9.

The computer 102 is connected with the cutting plotter 101 by using a dedicated cable such as a USB cable and RS-232C, a network, and wireless short-range communication. The computer 102 may have a form of a resource built in an Internet space.

Figure 4A:
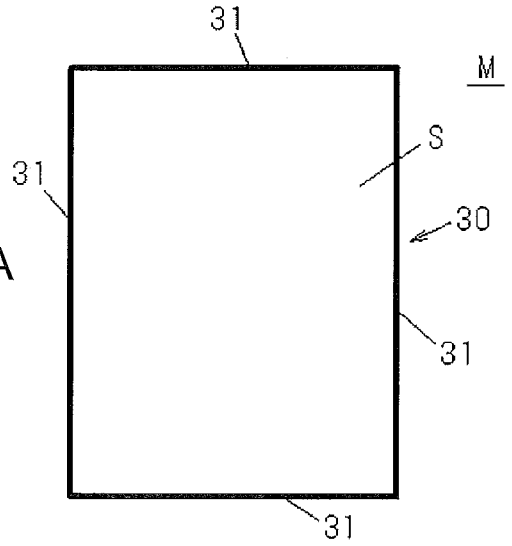
FIGS. 4A and 4B are plan views illustrating an example of a media that is cut by the cutting apparatus.
Figure 4B:
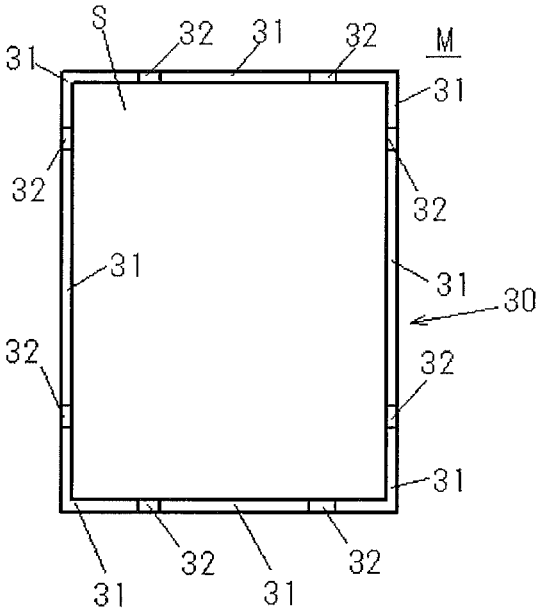

FIGS. 4A and 4B are plan views illustrating an example of the media that is cut by the cutting apparatus. In the embodiment of the present invention, when the processing path 30 is generated to cut the line segment 31 that constitutes the cut object S, the non-cutting portions 32 are set in part of the processing path 30, and a pre-cut is performed first in a state where the non-cutting portions 32 are left. Then, a full cut (complete cut of the cut object S) is performed by cutting the non-cutting portions 32. Hereinafter, the processing path 30 is illustrated in an enlarged and schematic manner for illustrative purposes.

Figure 5:
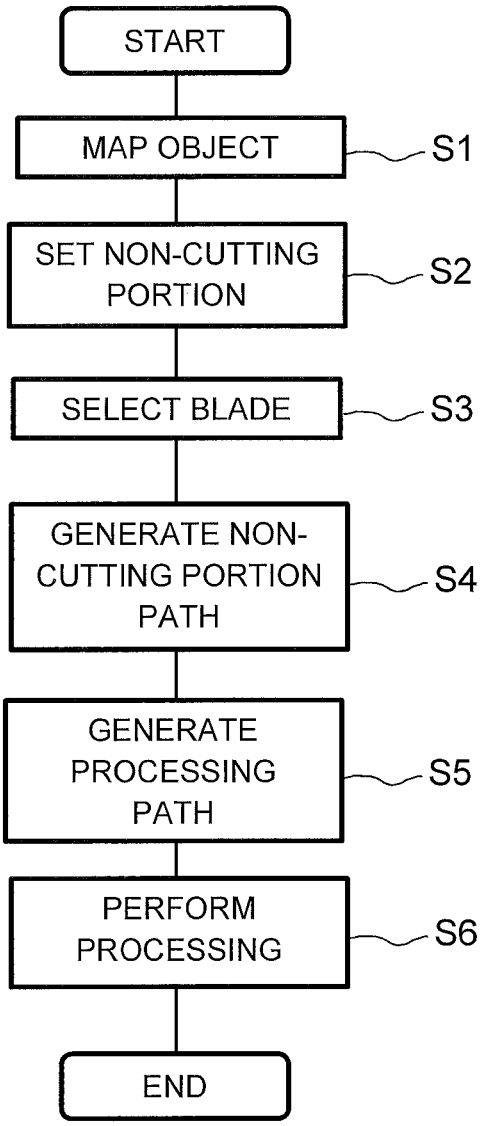
FIG. 5 is a flowchart illustrating an operation of the cutting apparatus according to an embodiment of the present invention.

FIG. 5 is a flowchart illustrating an operation of the cutting apparatus according to the embodiment of the present invention. First, a user maps the cut object S that is cut by using the mapping unit 21 (step S1). For example, the user maps the rectangular cut object S as illustrated in FIG. 4A. Data of the cut object S is sent from the computer 102 to the cutting plotter 101, and is printed onto the predetermined media M. Alternatively, the data is sent to another printer and printed onto the media M.

Next, the non-cutting portions 32 are set in part of the line segment 31 of the cut object S that is mapped (step S2). The non-cutting portion setting unit 25 superimposes data of the non-cutting portions 32 with data of the line segment 31 of the cut object S as the user specifies a desired position of the line segment 31 that constitutes the cut object S, and, as illustrated in FIG. 4B, the non-cutting portions 32 are automatically generated on the line segment 31. The specification of positions where the non-cutting portions 32 are generated may be automatically generated near both ends and in a center thereof just by selecting the line segment 31, or may be generated by specifying the line segment 31 and then numerically inputting a position on the line segment 31. A width of the non-cutting portion 32 can be set by the user in advance. Also, specification of the width of the non-cutting portion 32 can be performed for every specification of the non-cutting portion 32.

Next, the user selects the blade 20 used in the cutting by using the blade selection unit 24 (step S3). The selection of the blade 20 may precede the setting of the non-cutting portions 32 (step S2), or may be performed before the mapping of the cut object S (step S1). The blade 20 that can be selected is displayed on a screen. The blade selection unit 24 holds blade information such as a width, a thickness, and a blade edge angle of the blade 20.

The non-cutting portion processing path generation unit 26 generates the non-cutting portion processing path based on the blade information related to the blade 20 that is selected (step S4). FIGS. 6 to 12 are explanatory views illustrating examples of the non-cutting portion processing path that is generated.

Figure 6:
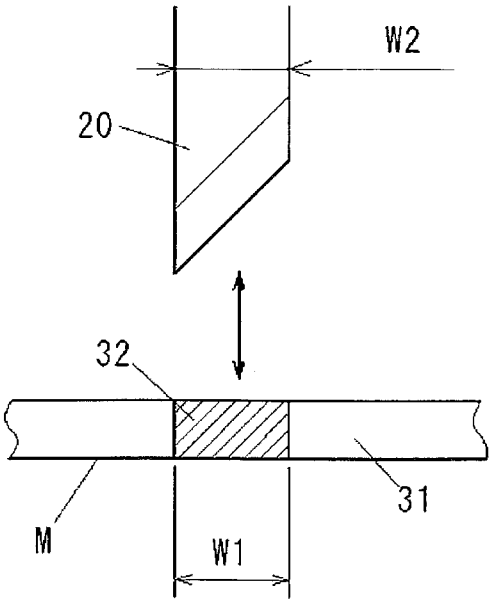
FIG. 6 is an explanatory view illustrating an example of a non-cutting portion processing path that is generated.

As illustrated in FIG. 6, in a case where a width W1 (length in a line segment 31 direction) of the non-cutting portion 32 is smaller than a width W2 of the blade 20, the non-cutting portion processing path is generated by lowering the blade 20 from above the non-cutting portion 32, inserting the blade into the non-cutting portion 32, and retracting the blade upward in that state. Specifically, a center position in the width direction of the non-cutting portion 32 is aligned with a center position of the blade 20, and the non-cutting portion processing path that vertically moves the blade with an insertion amount which is enough to completely cut the non-cutting portion 32 is generated. According to the non-cutting portion processing path, the non-cutting portion 32 can be cut without having to moving the media M, a jam attributable to the movement of the media M can be prevented, and the cut object S can be fully cut.

Figure 7A:
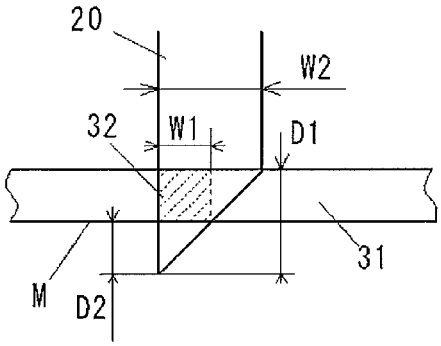
FIGS. 7A and 7B are explanatory views illustrating the example of the non-cutting portion processing path that is generated.

A preferable condition for a case where the media M and the blade 20 are not relatively moved will be described referring to FIGS. 7A and 7B. An insertion amount D1 of the blade 20 from a surface of the media M is an amount that is required to completely cut the non-cutting portion 32 by using the blade 20, and is highly dependent upon the blade edge angle of the blade 20. For example, in a case where the blade 20 that has a blade edge angle of 45 degrees is used, an amount D2 by which the blade penetrates the media M and is inserted into the platen 2 is the width W1 of the non-cutting portion 32 that is cut as illustrated in FIG. 7A.

Figure 7B:
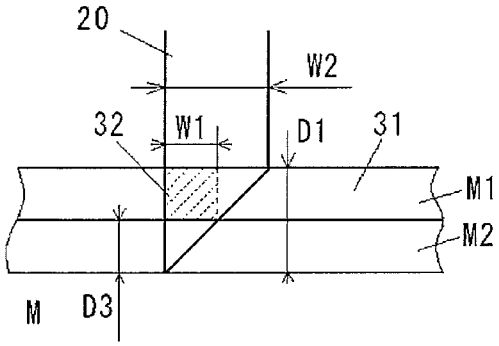

From another perspective, as illustrated in FIG. 7B, the width W1 of the non-cutting portion 32 may be equal to or smaller than a thickness D3 of a pasteboard M2 to completely cut the non-cutting portion 32 before the blade 20 reaches the platen 2 if, for example, the media M is a seal, the thickness of the pasteboard M2 and a thickness of the seal M1 are equal to each other, and the blade edge angle is 45 degrees. Accordingly, from a viewpoint of the cutting of the non-cutting portion 32, a maximum width of the non-cutting portion 32 that can be cut by the blade 20 (hereinafter referred to as the maximum cutting length of the blade 20) is determined from the insertion amount D1 of the blade 20 which is allowable based on such conditions as the type and the blade edge angle of the blade 20, the media M, and the platen 2. Accordingly, if the non-cutting portion 32 has a width that is smaller than the maximum cutting length of the blade 20 used in the cutting, the non-cutting portion 32 can be cut just by vertically moving the blade 20 with respect to the non-cutting portion 32.

Figure 8:
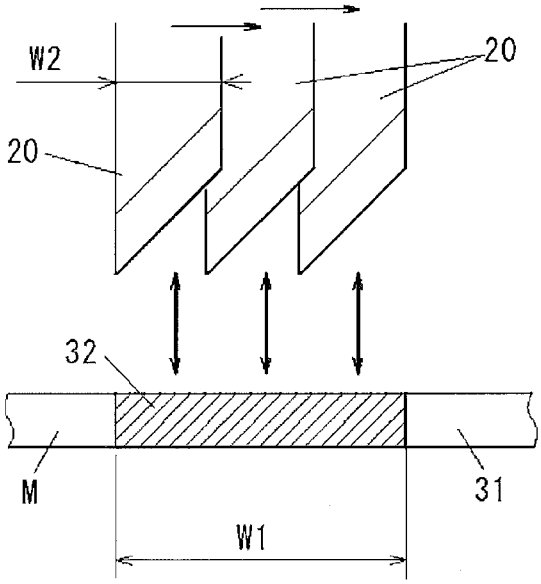
FIG. 8 is an explanatory view illustrating the example of the non-cutting portion processing path that is generated.

Next, in a case where the width W1 of the non-cutting portion 32 is larger than the maximum cutting length of the blade 20 as illustrated in FIG. 8, the non-cutting portion processing path is generated by lowering the blade 20 from above the non-cutting portion 32 across several occasions and inserting the blade 20 into the non-cutting portion 32. Specifically, as illustrated in the same figure, part of the non-cutting portion 32 is cut by inserting the blade 20 into the non-cutting portion 32, the blade 20 is temporarily lifted after the first cutting, and then the blade 20 and the media M are relatively moved slightly so that the blade 20 is inserted into the non-cutting portion 32 in such a manner as to continue from the first cutting portion. Then the blade 20 is lifted again after the second cutting, the blade 20 and the media M are relatively moved slightly again if necessary, and the blade 20 is inserted into the non-cutting portion 32 in such a manner as to continue from the second cutting portion so that the non-cutting portion processing path is generated in such a manner that the cutting is performed only for the width W1 of the non-cutting portion 32 which is cut in this manner.

According to the non-cutting portion processing path, the full cut can be performed without having to relatively move the media M and the blade 20 in the X-axis direction. A movement of the media M in a Y-axis direction is small even when a Y-axis direction component is included in the non-cutting portion 32. The amount of the movement of the media M does not necessarily have to exceed the width W1 of the non-cutting portion 32. For example, in the example of FIG. 8, the blade 20 is vertically moved across three occasions to perform the cutting, and thus the amount of the movement for each vertical movement is one-third of the width W1 of the non-cutting portion 32. When the cutting is performed on two occasions, the amount of the movement for each vertical movement is one-half of the width W1 of the non-cutting portion 32. Accordingly, the jam attributable to the movement of the media M can be prevented. Also, the processing path 30 can be applied to a case where the width W1 of the non-cutting portion 32 is smaller than the width W2 of the blade 20.

Figure 9A:
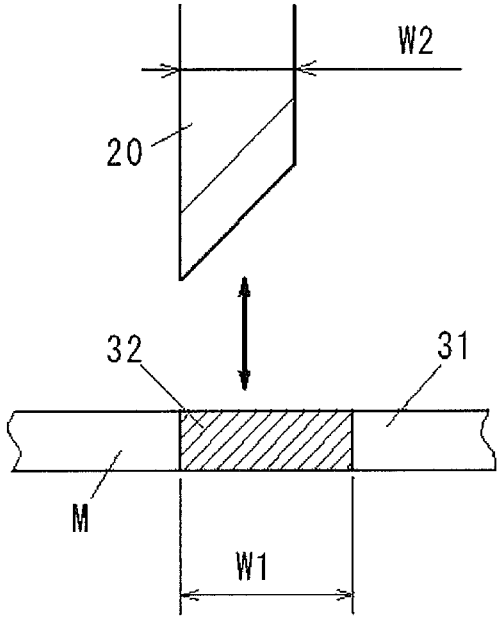
FIGS. 9A-9C are explanatory views illustrating the example of the non-cutting portion processing path that is generated.
Figure 9B:
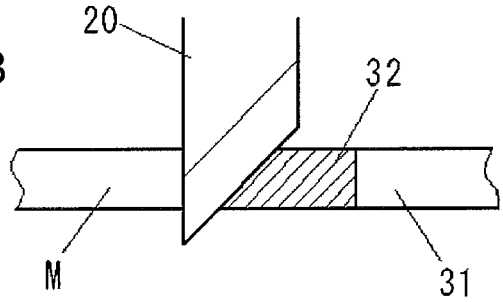
Figure 9C:
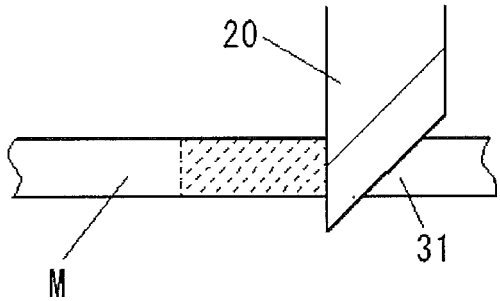

Next, in a case where the width W1 of the non-cutting portion 32 is larger than the maximum cutting length of the blade 20 as illustrated in FIGS. 9A-9C, the blade 20 is lowered from above an end of the non-cutting portion 32 and is inserted into the non-cutting portion 32 as illustrated in FIGS. 9A and 9B, and the non-cutting portion processing path is generated in such a manner that the blade is slightly moved in that state as illustrated in FIG. 9C. In other words, the normal cut by the blade 20 is performed within an extremely short range. In this manner, if the width W1 of the non-cutting portion 32 is relatively small, the relative movement of the blade 20 and the media M is small even when the normal cut is performed by the blade 20, and thus the jam of the media M can be prevented.

Figure 10A:
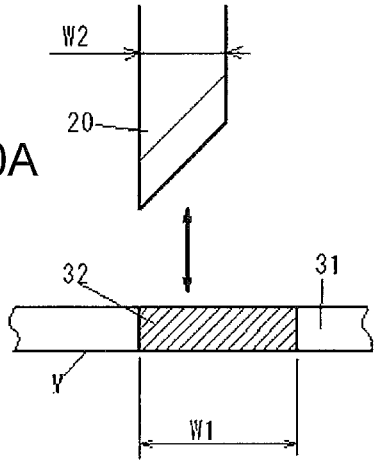
FIGS. 10A-10C are explanatory views illustrating the example of the non-cutting portion processing path that is generated.
Figure 10B:
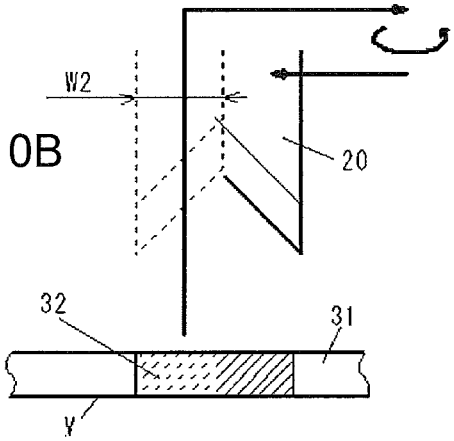
Figure 10C:
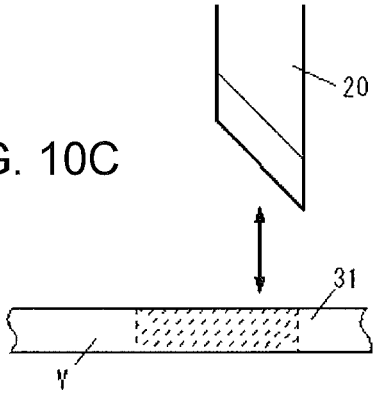

Next, in a case where the width W1 of the non-cutting portion 32 is larger than the maximum cutting length of the blade 20 as illustrated in FIGS. 10A-10C, the blade 20 is inserted into the non-cutting portion 32 for partial cutting on the first occasion as illustrated in FIG. 10A, the blade is temporarily lifted and the holder 8 is rotated by 180 degrees by the discarding as illustrated in FIG. 10B, and the non-cutting portion processing path is generated in such a manner that the blade 20 is inserted into the non-cutting portion 32 on the second occasion as illustrated in FIG. 10C.

Figure 11:
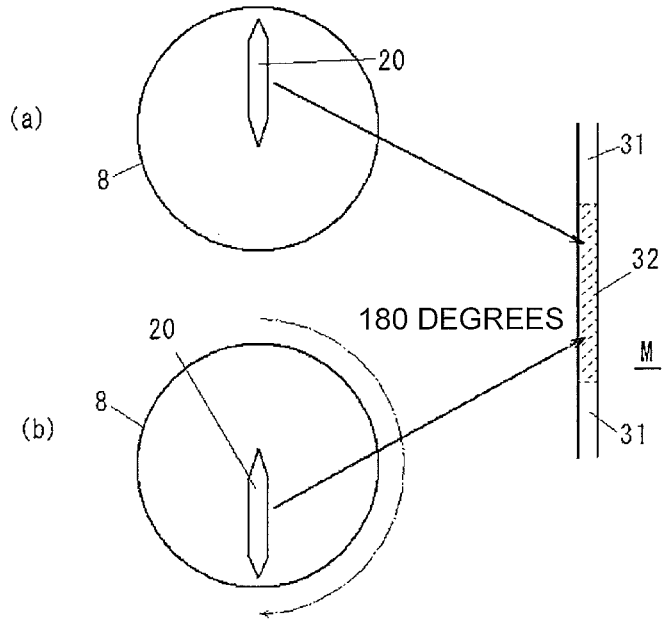
FIG. 11 is an explanatory view illustrating an example of cutting in a case where a holder is rotated.

FIG. 11 is an explanatory view illustrating an example of the cutting in a case where the holder 8 is rotated. In a case where the linear-shaped non-cutting portion 32 is cut, the blade 20 is inserted into part of the non-cutting portion 32 for partial cutting as shown by (*a*). Then, the blade 20 is lifted, and the holder 8 is rotated by 180 degrees to insert the blade into the non-cutting portion 32 and cut the remaining portion for full cutting as shown by (*b*). The blade 20 is eccentrically installed with respect to the holder 8, and thus the non-cutting portion 32, which has a maximum width twice as long as the blade 20 for the rotation of the holder 8, can be cut without having to relatively move the blade 20 and the media M.

Figure 12:
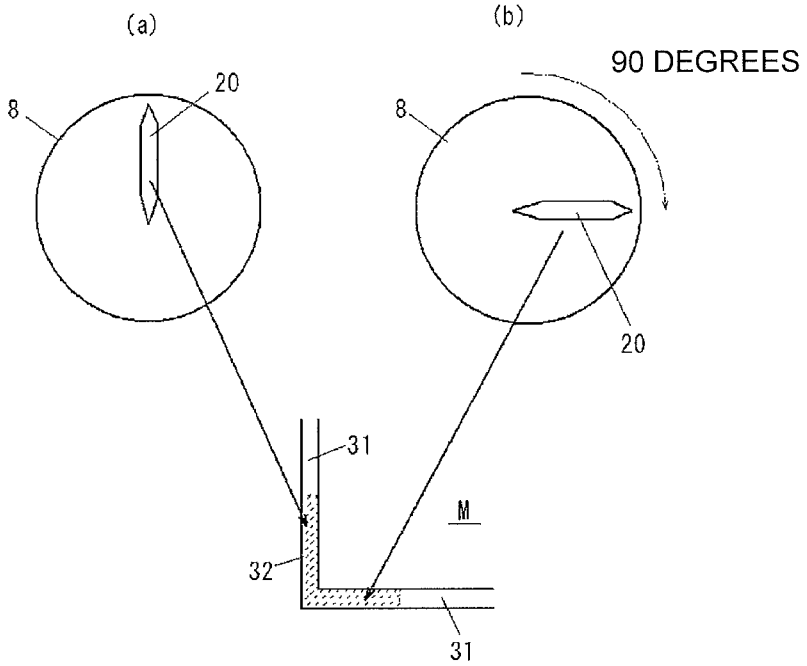
FIG. 12 is an explanatory view illustrating another example of the cutting in the case where the holder is rotated.

Also, in a case where the non-cutting portion 32 is disposed at a corner of the cut object S as illustrated in FIG. 12, the non-cutting portion 32 at the corner can be cut by rotating the holder 8. In other words, the blade 20 is inserted into the non-cutting portion 32 for partial cutting on the first occasion as shown by (*a*), and the blade is temporarily lifted, the holder 8 is rotated by a predetermined angle by the discarding, and the blade 20 is inserted into the non-cutting portion 32 on the second occasion as shown by (*b*). The non-cutting portion processing path is generated so that this is performed with respect to the non-cutting portion 32 that is set at the corner of the line segment 31. In this case, the non-cutting portion 32 can be cut and the cut object S can be fully cut without having to move the media M even when the non-cutting portion 32 is set on the line segment 31 of the cut object S and the corner of the line segment 31. Accordingly, the jam attributable to the movement of the media M can be prevented.

Furthermore, it is possible to generate the non-cutting portion processing path by combining the methods for cutting the non-cutting portion 32 that are illustrated in FIGS. 6 to 12. For example, the cutting method illustrated in FIG. 6 is applied to the non-cutting portion 32 whose width is smaller than the width of the blade 20, and the cutting method illustrated in FIGS. 7A and 7B is applied to the non-cutting portion 32 whose width is larger than the width of the blade 20.

Returning to FIG. 5, the processing path generation unit 23 generates the processing path 30 of the cut object S by using the non-cutting portion processing path which is generated by the non-cutting portion processing path generation unit 26 (step S4). The processing path 30 is divided into a cut step for the pre-cut and a cut step for the full cut. The cut step for the pre-cut is by the processing path illustrated in FIG. 13A that will be described later. The cut step for the full cut is by the processing path illustrated in FIG. 13B that will be described later. The processing path is generated based on a side that is a product (cut object S), a side that is not the product, the type of the blade 20, the non-cutting portion processing path and the like.

The processing path 30 that is automatically generated is sent from the computer 102 to the controller 103 of the cutting plotter 101. The control unit 22 of the controller 103 controls the driver units 11 and 12 following the processing path 30 and drives the motors 6, 7, and 10 and the actuator 9 (step S6). The media M on which the cut object S is printed is set by the user at a predetermined position of the cutting plotter 101. The media M, if possible, is set along a right end of the platen 2. The user presses a jog key of the cutting plotter 101 to detect a starting point of the media M and start the processing.

Figure 13A:
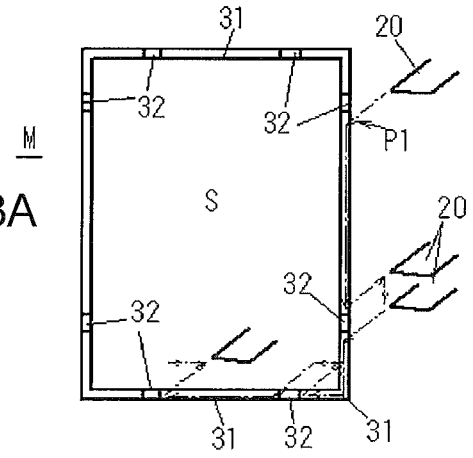
FIGS. 13A-13C are explanatory views illustrating a specific example of processing in a case where a non-cutting portion whose width is smaller than a width of a blade is generated.
Figure 13B:
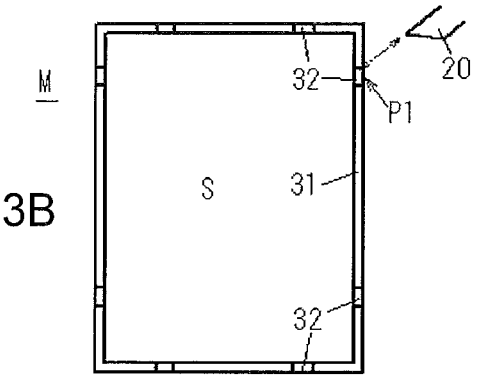
Figure 13C:
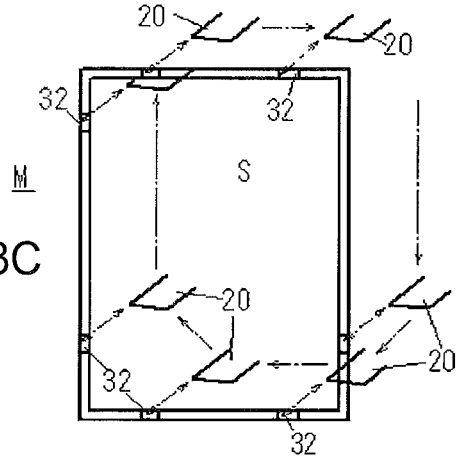

A specific example of the processing in a case where the non-cutting portion 32 whose width W1 is smaller than the width W2 of the blade 20 is generated will be described referring to FIGS. 13A-13C. The following operation is performed by the control unit 22 following the processing path that is generated. First, as illustrated in FIG. 13A, positioning is performed on the blade 20 by moving the cutter unit 1 following the processing path 30 that is generated to above a cut starting point P1 of the line segment 31 that constitutes the cut object S, and subsequently the blade 20 is lowered in the Z-axis direction (at this time, the blade 20 is directed in the cut direction of the line segment 31 by the discarding). Subsequently, the driving of the cutter unit 1 and the grid roller 3 is controlled following the processing path 30, and the blade 20 is relatively moved with respect to the media M to perform the cutting on the line segment 31.

Subsequently, when the cut of the line segment 31 is in progress to reach the non-cutting portion 32, the movement of the blade 20 is stopped and the blade 20 is lifted upward. The blade 20 is moved by the same amount as the width W1 of the non-cutting portion 32 with the blade 20 being lifted upward, and then the blade 20 is lowered again onto the line segment 31. In this state, the driving of the cutter unit 1 and the grid roller 3 is controlled following the processing path 30, and the media M and the blade 20 are relatively moved to resume the cutting of the line segment 31.

When the blade 20 reaches the next non-cutting portion 32, the movement of the blade 20 is stopped as described above, and the blade 20 is lifted upward. The non-cutting portion 32 is moved by the same amount as the width W1 with the blade 20 being lifted upward, and the blade 20 is lowered again onto the line segment 31. In this state, the driving of the cutter unit 1 and the grid roller 3 is controlled following the processing path 30, and the media M and the blade 20 are relatively moved to perform the cutting on the line segment 31. In this manner, the cutting is performed on the line segment 31 in a state where all of the non-cutting portions 32 are left. The non-cutting portions 32 are completely cut later, and thus there is no problem even when the blade 20 is overrun with respect to the non-cutting portions 32.

When the cutting of the line segment 31 excluding the non-cutting portions 32 is completed, the complete cutting of the non-cutting portions 32 is performed by following the method illustrated in FIG. 6. As illustrated in FIG. 13B, the control unit 22 moves the cutter unit 1 to above the non-cutting portion 32 near the cut starting point P1, and aligns the direction of the blade 20 with the width direction of the non-cutting portion 32. Also, since a front side of a blade tip of the blade 20 is polished at an angle, a side where a cut end is perpendicular is the product side. The direction of the blade 20 is aligned by rotating the holder 8 by a predetermined angle. The blade 20 is lowered and is inserted into the non-cutting portion 32, and the non-cutting portion 32 is cut.

Returning to FIG. 5, when the first non-cutting portion 32 is completely cut, the blade 20 is lifted, the blade 20 and the media M are relatively moved, and the blade 20 is moved to above the second non-cutting portion 32 to align the direction of the blade 20 with the width direction of the non-cutting portion 32. Also, as described above, the side where the cut end is perpendicular after the cutting is the product side. The blade 20 is lowered and is inserted into the non-cutting portion 32, and the non-cutting portion 32 is completely cut. When the second non-cutting portion 32 is completely cut, the blade 20 is lifted again, and, as illustrated in FIG. 13C, the third and the subsequent non-cutting portions 32 are cut in order as described above.

Figure 14:
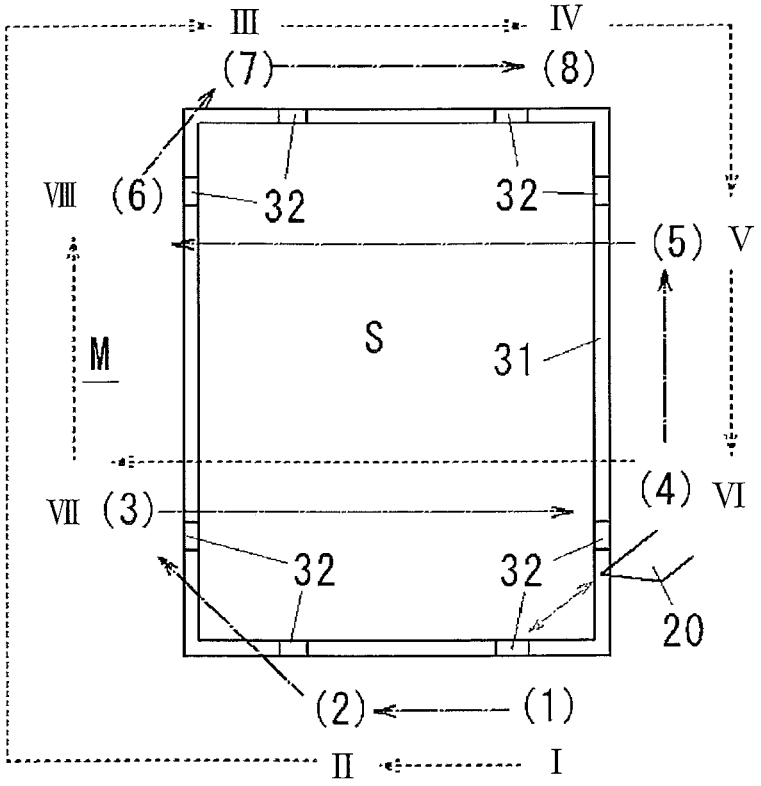
FIG. 14 is an explanatory view illustrating another specific example of the processing in the case where the non-cutting portion whose width is smaller than the width of the blade is generated.

The order in which the plurality of non-cutting portions 32 are cut is not limited to the above description. For example, as illustrated in FIG. 14, the cut is performed with the non-cutting portions 32 being left, and then the media M is temporarily back-fed and the non-cutting portions 32 are cut in order from the side of the direction of the movement in the Y-axis direction so that the grid roller 3 does not cause the media M to reciprocate. An example of the cutting order is illustrated with the numbers of (1) to (8) in FIG. 14. In this case, the media M may be moved by the grid roller 3 in just one direction, and the media M does not have to be operated forward and backward. Accordingly, the jam attributable to the movement of the media M can be prevented. The order in which the non-cutting portion 32 is cut is not limited to what is illustrated in FIG. 14 if the cutting is performed from one side of the direction of the movement of the media.

Also, in the cutting apparatus 100, the cutting order may be selected in such a manner that the number of the discarding is decreased by performing the discarding on an unnecessary portion of the media M and changing the direction of the blade 20. For example, the cutting is performed in order of (I) to (VIII) in FIG. 14. Specifically, the cutting of the non-cutting portions 32 is performed first in order of (I), (II), (III), and (IV) that are cutting in a transverse direction in the figure, and then the blade 20 is rotated in a longitudinal direction in the figure by the discarding so that the cutting of the non-cutting portions 32 is performed in order of (V), (VI), (VII), and (VIII). In other words, the non-cutting portions 32 that are directed in the same direction are cut first, and then the non-cutting portions 32 that are directed in the other direction are cut. In this case, the number of the discarding is decreased, and the processing time can be shortened.

Figure 15:
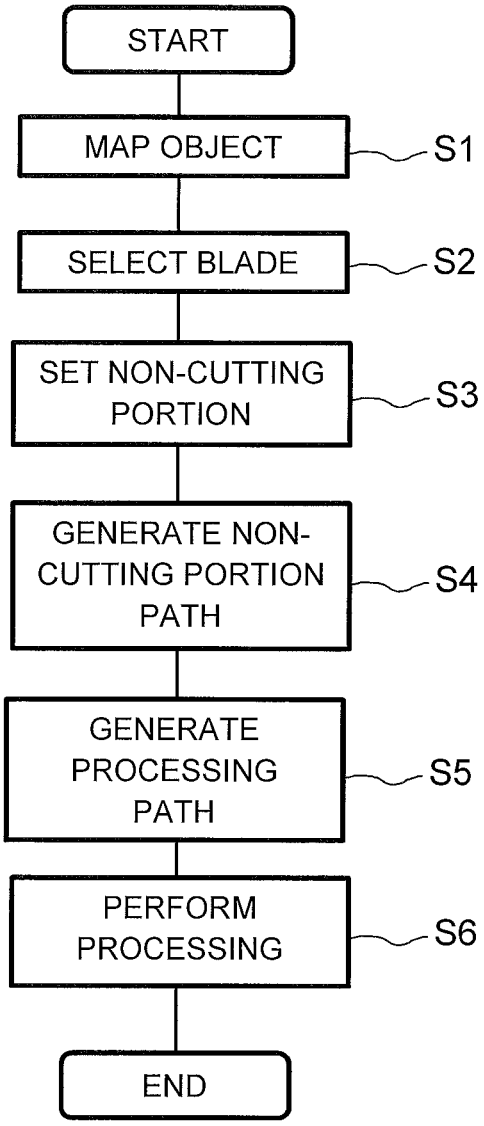
FIG. 15 is a flowchart illustrating another operation of the cutting apparatus according to another embodiment of the present invention.

Also, the setting of the non-cutting portions 32 of the processing process illustrated in FIG. 5 (step S2) and the selection of the blade 20 (step S3) may be switched in order with each other. FIG. 15 is a flowchart illustrating another operation of the cutting apparatus according to the embodiment of the present invention. The additional process is the same as the example illustrated in FIG. 5, and the description will be omitted herein.

The user selects the blade 20 used in the cutting by using the blade selection unit 24 (step S2). At this time, the blade 20 that can be selected is displayed on the screen. The blade selection unit 24 has the blade information such as the width, the thickness, and the blade edge angle of the blade 20 related to each of the blades 20 that can be selected. After the user selects the blade 20, the non-cutting portion setting unit 25 determines the width of the non-cutting portion 32 based on the width of the blade 20 that is selected (step S3).

Figure 16:
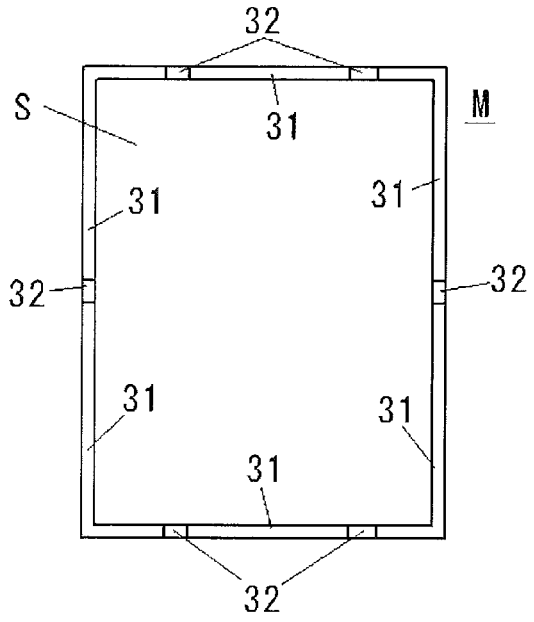
FIG. 16 is an explanatory view illustrating an example in which the non-cutting portion whose width is smaller than the width of the blade is set in a line segment of a cut object.

As a first example, a setting unit 26 for the non-cutting portion 32 sets the non-cutting portion 32 whose width is smaller than the maximum cutting length of the blade 20 that is selected. FIG. 16 illustrates the example in which the non-cutting portion whose width is smaller than the width of the blade is set on the line segment of the cut object. In the non-cutting portion setting unit 25, the width of the non-cutting portion 32 is automatically set by the blade 20 that is selected, and thus the user can automatically generate the non-cutting portion 32 of that width on the line segment 31 by selecting or inputting the desired position on the line segment 31. The non-cutting portion processing path generation unit 26 generates the cutting path illustrated in FIG. 6. In this case, the non-cutting portion 32 can be cut without having to relatively move the media M and the blade 20 by inserting the blade 20 into the non-cutting portion 32.

Figure 17:
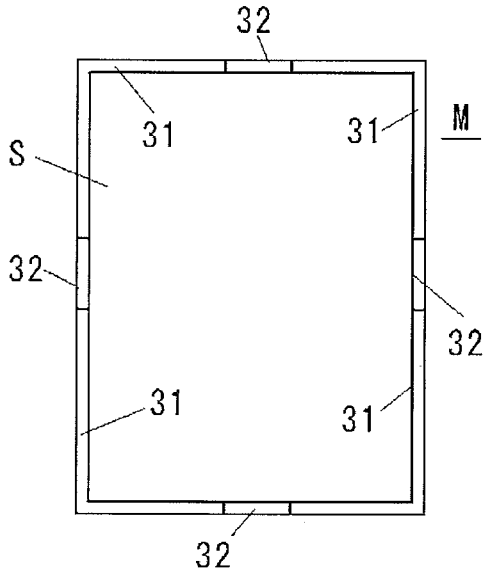
FIG. 17 is an explanatory view illustrating an example in which a non-cutting portion whose length is larger than the blade length is set in the line segment of the cut object.

As a second example, the non-cutting portion setting unit 25 sets the non-cutting portion 32 whose width can be cut by inserting the blade 20 on a plurality of occasions. FIG. 17 illustrates the example in which the non-cutting portion 32 whose width is larger than the width of the blade 20 is set on the line segment 31 of the cut object S. The non-cutting portion processing path generation unit 26 generates the cutting path illustrated in FIGS. 7A and 7B. In this case, the non-cutting portion 32 can be cut by inserting the blade 20 into the non-cutting portion 32 across a plurality of occasions and relatively moving the media M and the blade 20 slightly. In this case, the optimal non-cutting portion 32 is generated based on the width W2 of the blade 20, and the cutting path thereof is also generated, and thus the jam of the media M does not occur.

In the above-described cutting apparatus 100 according to the first embodiment of the present invention, the non-cutting portion 32 is cut and the full cut is performed on the cut object S without or slightly moving the media M after the cutting is performed in such a manner as to leave the non-cutting portion 32 when the line segment 31 of the cut object S is cut. Accordingly, the jam of the media M does not occur. In particular, if the non-cutting portion 32 is smaller than the maximum cutting length of the blade 20, the non-cutting portion 32 can be cut just by vertically moving the blade 20, and thus the media M does not have to be moved and the j am can be further prevented.

Even in the case where the width W1 of the non-cutting portion 32 is larger than the maximum cutting length of the blade 20, the non-cutting portion 32 can be cut without having to move the media M by slightly moving the blade 20 across several occasions while vertically moving the blade to insert the blade into the non-cutting portion 32, and thus the jam can be further prevented. Also, in the case where the blade 20 is eccentrically installed in the holder 8, the non-cutting portion 32 that is larger than the maximum cutting length can be cut without having to move the media M by rotating the holder 8.

Furthermore, if the non-cutting portion 32 is cut in order from one direction of the media M, the media M is not operated forward and backward, and thus the jam of the media M is further prevented. Also, from the viewpoint of reducing the number of the discarding, the processing time can be shortened if the cutting is performed in order from the non-cutting portions 32 in the same direction.

Second Embodiment

In the above-described first embodiment, the holder 8 has the rotatable structure, and the blade 20 is directed in a predetermined direction by the discarding operation. However, the rotation of the holder 8 may be controlled by a servo motor. In this case, the servo motor is placed as the above-described actuator 9, and the servo motor is controlled by the computer 102 and the controller 103. According to this configuration, the processing time can be substantially shortened when compared to the cutting apparatus 100 according to the first embodiment since the discarding operation does not have to be performed and the positioning of the direction of the blade 20 can be performed. The configuration in which the holder 8 is rotated by the servo motor is suitable for the case in which the cutting is performed by rotating the blade 20 as illustrated in FIGS. 10 and 11.

Obviously, numerous modifications and variations of the present invention are possible in light of the above teachings. It is therefore to be understood that within the scope of the appended claims, the invention may be practiced otherwise than as specifically described herein.

What is claimed is:

1. A method for controlling a cutting plotter, comprising:

moving a blade in a first direction parallel to a surface of a medium and moving the medium forward and backward in a second direction crossing the first direction and parallel to the surface of the medium to relatively move the blade along a cutting line having a pair of farthest points in the second direction on the medium to pre-cut the medium along the cutting line to leave non-cutting portions having a first non-cutting portion positioned closest to a first farthest point of the pair of farthest points;

relatively moving the blade and the medium to position the blade at the first non-cutting portion;

cutting the first non-cutting portion; and moving the blade in the first direction and moving the medium only forward or only backward in the second direction from the first farthest point to a second farthest point of the pair of farthest points to position the blade at each of the non-cutting portions so that all of the non-cutting portions are cut off after cutting the first non-cutting portion.

2. The method according to claim 1, further comprising:

setting the non-cutting portions on the cutting line of the medium;

generating a non-cutting portion processing path so as to cut the non-cutting portions based on a length of each of the non-cutting portions; and generating a processing path of the cutting line using the non-cutting portion precessing path.

3. The method according to claim 1, further comprising:

setting a width of each of the non-cutting portions smaller than a width of the blade; and generating a path used to cut the non-cutting portions based on the width of each of the non-cutting portions.

4. The method according to claim 1, further comprising:

moving the blade toward the medium in a third direction perpendicular to the first direction and the second direction after the blade is positioned at each of the non-cutting portions without relatively moving the blade and the medium in the first direction and the second direction to cut an entirety of each of the non-cutting portions after pre-cutting the medium so that all of the non-cutting portions are cut off.

5. The method according to claim 1, further comprising:

moving the blade toward the medium in a third direction perpendicular to the first direction and the second direction after the blade is positioned at each of the non-cutting portions with relatively moving the blade and the medium in the first direction and the second direction to cut an entirety of each of the non-cutting portions after pre-cutting the medium so that all of the non-cutting portions are cut off.

6. The method according to claim 1, wherein a length of each of the non-cutting portions is smaller than a maximum cutting length of a cutting portion made by inserting the blade into the medium by an maximum allowable insertion amount.

7. The method according to claim 1, wherein the non-cutting portions are cut by vertically moving the blade a plurality of times with respect to the non-cutting portions and by moving the blade along the cutting line every time the blade vertically moves.

8. The method according to claim 1, wherein a rotating holder rotates the blade every time the blade vertically moves with respect to the non-cutting portions.

9. The method according to claim 1, wherein the blade cuts the non-cutting portions in order from one side of the medium in a moving direction of the medium.

* * * * *